United States Patent [19]

Senior, III

[11] 4,355,671

[45] Oct. 26, 1982

[54] WOOD SPLITTING TOOL

[76] Inventor: Albert B. Senior, III, Box 290, Middletown, Del. 19709

[21] Appl. No.: 229,106

[22] Filed: Jan. 28, 1981

[51] Int. Cl.[3] ..... B27L 7/00

[52] U.S. Cl. ..... 144/193 C; 125/40; 145/30 S; 173/91

[58] Field of Search ..... 145/29 B, 2 R, 30 S, 145/61 F; 173/91; 125/40; 299/23; 144/193 R, 193 C, 193 D

[56] References Cited

U.S. PATENT DOCUMENTS

| | | | |
|---|---|---|---|
| 3,568,657 | 3/1971 | Gue | 173/91 X |
| 4,006,763 | 2/1977 | Ordonez | 145/30 S |
| 4,183,385 | 1/1980 | Burkyble | 145/29 A |

FOREIGN PATENT DOCUMENTS

| | | | |
|---|---|---|---|
| 185266 | 4/1956 | Austria | 144/193 D |

*Primary Examiner*—W. D. Bray

*Attorney, Agent, or Firm*—Connolly and Hutz

[57] ABSTRACT

Wood splitting tool comprises head with handle secured thereto. Head includes wedge having wood engaging portion and opposite top surface portion. Pin is secured to wedge and extends outwardly from top surface portion thereof, and impact weight is slidably mounted on pin. Enlargement at free end of pin prevents removal of impact weight so that upon swinging tool weight slides along pin and strikes top surface portion of wedge to provide second hit immediately after edge portion of wedge engages wood being split.

9 Claims, 4 Drawing Figures

WOOD SPLITTING TOOL

BACKGROUND OF THE INVENTION

The present invention relates to a wood splitting tool, and more particularly to such a tool having impact structure that provides a second hit immediately after the tool engages the wood being split.

Prior to the present invention numerous devices have been proposed for splitting wood. For the most part each of these devices utilizes the principle of a simple wedge which separates the wood along the grain as force is applied to the wedge. In the case of hand tools, the force is applied by swinging the tool in the direction of and into the wood. As is well known, separation of the wood along the grain ultimately leads to splitting of the wood. The present invention is an improvement over these heretofore proposed devices.

SUMMARY OF THE INVENTION

Accordingly, it is an object of the present invention to provide a wood splitting tool which is easy to use and which is efficient and effective in splitting wood.

Another object of the present invention is a wood splitting tool which upon being swung provides a second hit immediately after the tool engages the wood being split.

In accordance with the present invention a wood splitting tool comprises a head with a handle secured thereto and extending therefrom. The head includes a wedge having a wood engaging edge portion and an opposite top surface portion, and a pin is secured to the wedge and extends outwardly from the top surface portion thereof. An impact weight is slidably mounted on the pin, and an enlargement at the free end of the pin prevents removal of the impact weight. Upon swinging the tool, the weight slides along the pin and strikes the top surface portion of the wedge to provide a second hit immediately after the edge portion of the wedge engages the wood.

The wood engaging edge portion of the wedge and the impact weight are on opposite sides of the axis of the handle. Preferably the top surface portion of the wedge is generally flat. Also, the pin may be integral with the wedge by a weld and/or the wedge may include a countersunk bore with the pin securely fitted into the bore.

The impact weight includes a central passageway extending therethrough slightly larger than the cross-sectional dimensions of the pin. Preferably the impact weight is cylindrical and the central passageway extends along the axis of the cylindrical weight. Also, it is preferred that the length of the pin be at least twice as long as the impact weight, and most preferably that the length of the pin be approximately six inches and the length of the impact weight approximately one and three-quarters inches. Finally, it is preferred that the wedge be approximately nine pounds and the impact weight be approximately four pounds.

BRIEF DESCRIPTION OF THE DRAWING

Novel features and advantages of the present invention will become apparent to those skilled in the art from a reading of the following detailed description in conjunction with the accompany drawing wherein similar reference characters are used to identify similar parts and wherein.

DETAILED DESCRIPTION OF THE INVENTION

Figures 1, 2, 3, 4:
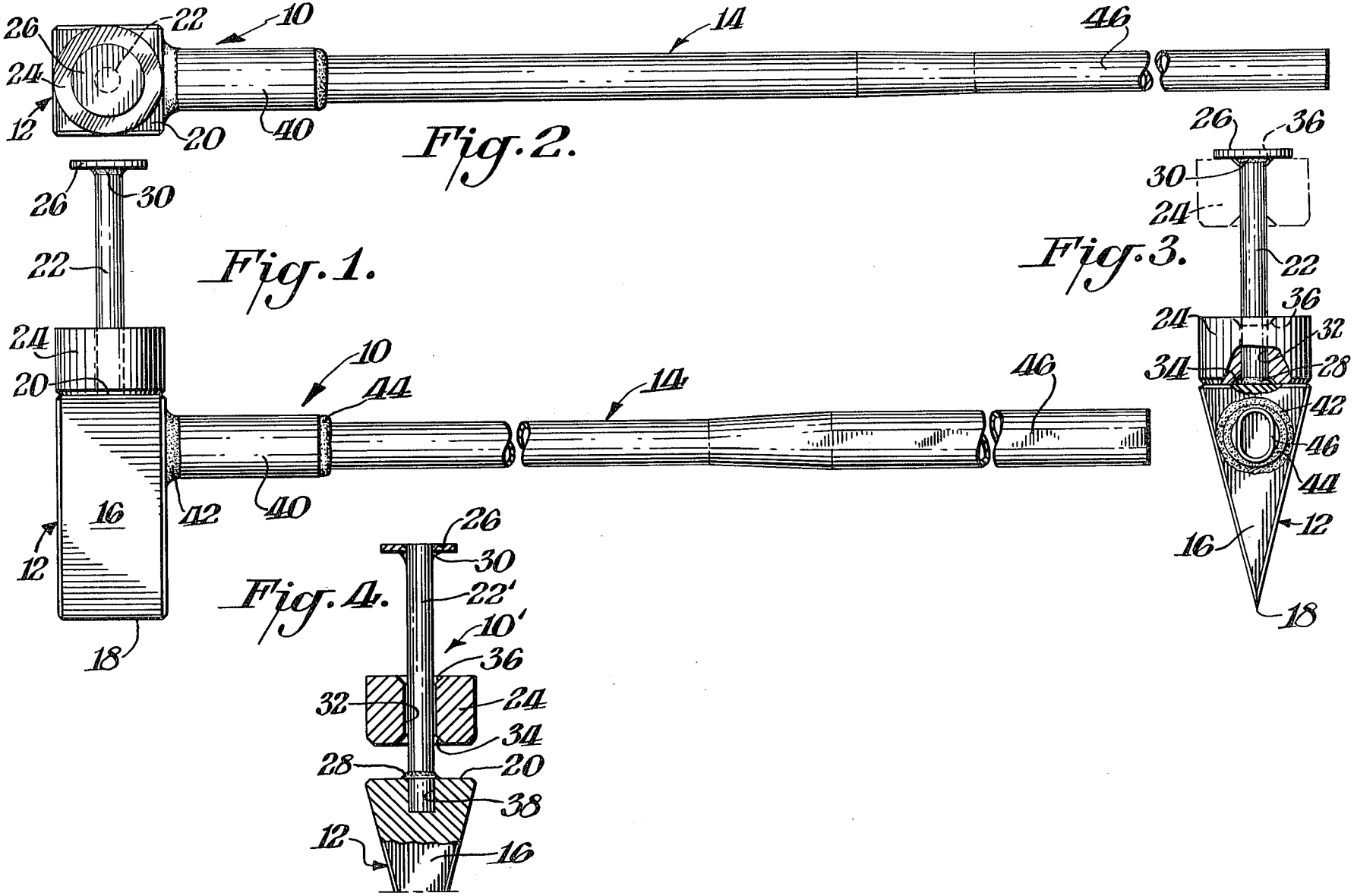
FIG. 1 is a side elevational view of a wood splitting tool according to the present invention.
FIG. 2 is a top plan view of the wood splitting tool shown in FIG. 1.
FIG. 3 is a righthand elevational view of the wood splitting tool shown in FIGS. 1 and 2 with portions thereof broken away to show detail and with the impact weight shown in phantom outline at the other extreme of its sliding movement.
FIG. 4 is a lefthand elevational view of another wood splitting tool according to the present invention with portions thereof broken away and other portions shown in section.

Referring in more particularity to the drawing, FIGS. 1–3 illustrate a wood splitting tool 10 comprising a head 12 with a handle 14 secured to the head and extending therefrom. The head 12 includes a wedge 16 having a wood engaging edge portion 18 and an opposite top surface portion 20. A pin 22 in the form of a rod having a circular cross section is secured to the wedge 16 and extends outwardly from the top surface portion 20 thereof. An impact weight 24 is slidably mounted on the pin for movement along the surface of the pin during the wood splitting operation. An enlargement 26 is secured at the free end of the pin 22 for preventing removal of the impact weight 24, as explained more fully below.

Preferably, the pin 22 is secured to the top surface 20 of the wedge 16 by a weld 28. Similarly, the enlargement 26 is secured to the outer free end of the pin 22 by a weld 30.

As shown best in FIG. 3, the impact weight 24 includes a central passageway which is slightly larger than the cross sectional dimensions of the pin 22. Such relationship enables the impact weight to slide along the pin during swinging of the tool. Preferably the impact weight 24 is cylindrical and the central passageway 32 extends along the axis of the cylindrical weight. Also, the opposite ends of the impact weight 24 include countersunk portions 34,36 dimensioned to accommodate the welds 28,30 during movement of the impact weight between the extremes of its sliding motion.

As is clear from the drawing, the wood engaging edge portion 18 of the wedge 16 and the impact weight 24 are on opposite sides of the axis of the handle 14. Also, the top surface portion 20 of the wedge 16 is generally flat.

FIG. 4 illustrates another embodiment 10'' of the present invention wherein similar parts are identified by similar reference characters. The wood splitting tool 10' differs from the embodiment of FIGS. 1–3 in that the pin 22' extends into a countersunk bore 38 in the wedge 16. This arrangement provides increased stability of the pin and wedge combination.

While the handle 14 may be fabricated in a variety of different ways, it is preferred that the handle be constructed from one inch steel pipe with the pipe welded directly to the wedge 16. Also, a short sleeve 40 is positioned over the handle adjacent the wedge 16 to reenforce the handle at its point of connection to the wedge. A weld 42 functions to secure the sleeve 40 to the wedge 16 while an inner weld underneath weld 42 serves to secure the one inch steel pipe to the wedge. The outer end of the sleeve 40 is welded at 44 to the steel pipe. The free end portion of the handle 14 is crimped out of round at 46 to provide an enlarged dimension in the vertical position so that the user's hands fit on the handle such that the edge portion 18 of the wedge 16 is pointing down.

In use, the handle 14 of the wood splitting tool 10 or 10' is grasped by the user at the free end portion where the handle is crimped out of round. Rearward swinging motion of the tool causes the impact weight 24 to slide along the pin 22 or 22' to the position shown in phantom outline in FIG. 3. During the forward swing of the tool, the impact weight 24 remains in its outer position against the enlargement 26 until the edge portion 18 of the wedge 16 engages the wood being split. Immediately after the edge portion engages the wood, the impact weight 24 slides along the pin 22 or 22' and strikes the surface portion 20 of the wedge to thereby provide a second hit. Such second hit further drives the wedge into the wood being split causing the wood to separate further. Hence, with one swing of the wood splitting tool 10 or 10', a double movement of the wedge occurs forcing it further into the wood and thereby aiding in the wood splitting operation.

The wedge 16 and the impact weight 24 may be fabricated from hot rolled steel with the wedge being approximately nine pounds and the impact weight being approximately four pounds. Preferably the top surface portion 20 of the wedge measures about three inches square, and the distance from the wood engaging edge portion 18 to the surface portion 20 is about six inches. This makes the sloping sides of the wedge slightly in excess of six inches. Continuing, the pin 22 or 22' is about six inches in length and has a diameter of about three-quarters inch. The cylindrical impact weight 24 has a diameter of about three inches and a height of about one and three-quarters inches. The central passageway 32 which extends through the weight 24 has a diameter slightly greater than three-quarters inch which enables the impact weight to freely slide on the pin 22 or 22'. The enlargement 26 is in the form of a round cap having a diameter of approximately two inches and the enlargement is fabricated from one-quarter inch steel.

What is claimed:

1. A wood splitting tool comprising a head with handle means secured thereto and extending therefrom, the head including a wedge having a wood engaging edge portion and an opposite top surface portion, a pin secured to the wedge and extending outwardly from the top surface portion thereof, an impact weight slidably mounted on the pin, and means at the free end of the pin for preventing removal of the impact weight whereby upon swinging the tool the weight slides along the pin and strikes the top surface portion of the wedge to provide a second hit immediately after the edge portion of the wedge engages the wood, and wherein the wood engaging edge portion of the wedge and the impact weight are on opposite sides of the axis of the handle means.

2. A wood splitting tool as in claim 1 wherein the top surface portion of the wedge is generally flat.

3. A wood splitting tool as in claim 1 wherein the pin is integral with the wedge by a weld extending between the pin and wedge.

4. A wood splitting tool as in claim 1 wherein the wedge includes a countersunk bore and the pin is securely fitted into the bore.

5. A wood splitting tool as in claim 1 wherein the impact weight includes a central passageway extending therethrough slightly larger than the cross-sectional dimensions of the pin.

6. A wood splitting tool as in claim 5 wherein the impact weight is cylindrical and the central passageway extends along the axis of the cylindrical weight.

7. A wood splitting tool as in claim 1 wherein the length of the pin is at least twice as long as the length of the impact weight.

8. A wood splitting tool as in claim 7 wherein the length of the pin is approximately six inches and the length of the impact weight is approximately one and three-quarter inches.

9. A wood splitting tool as in claim 1 wherein the wedge is approximately nine pounds and the impact weight is approximately four pounds.

* * * * *